US005946951A

United States Patent [19]

Watanabe

[11] Patent Number: 5,946,951

[45] Date of Patent: Sep. 7, 1999

[54] AUXILIARY DEVICE FOR ACTIVATING CLEANING WATER

[75] Inventor: Tadao Watanabe, Tsuchiura, Japan

[73] Assignee: Daikyo Co., Ltd., Tsuchiura, Japan

[21] Appl. No.: 09/055,171

[22] Filed: Apr. 3, 1998

[51] Int. Cl.[6] ..... D06F 39/00; C11D 17/02

[52] U.S. Cl. ..... 68/235 R; 68/17 R; 206/0.5; 510/276; 510/281; 510/295; 510/439

[58] Field of Search ..... 8/137, 158, 159; 68/17 R, 235 R; 206/0.5; 510/276, 281, 295, 297, 439

[56] References Cited

U.S. PATENT DOCUMENTS 4,255,273 3/1981 Sakkab ..... 510/281 X
5,211,689 5/1993 Kobayashi ..... 206/0.5
5,658,870 8/1997 Leu ..... 510/276
5,682,774 11/1997 Baumgartner ..... 68/235 R

*Primary Examiner*—Philip R. Coe
*Attorney, Agent, or Firm*—Dilworth & Barrese

[57] ABSTRACT

This invention is to be put in the washing machine vat with clothing and finely dividing hydro molecule cluster of the washing water by which the washing water permeates into the fiber of the clothing a generally disk shaped vessel main body is configured to be raised at its upper and lower surfaces where numerous water passing holes or perforations are formed for passing water there-through, a shock absorber is attached on the vessel main body at its side periphery face; a float is attached on the main body at its upper center, and a ceramic ball, tormaline resin, magnet and copper fiber are contained in the vessel main body.

5 Claims, 14 Drawing Sheets

AUXILIARY DEVICE FOR ACTIVATING CLEANING WATER

BACKGROUND OF THE INVENTION

1. Field of the Invention

This invention relates to an auxiliary device set in a washing machine, to activate cleaning water therein, and more particularly the device incorporating an element to activate the cleaning water in a vessel drifting in the cleaning water in the washing machine vat.

The device of this invention is set in the washing machine vessel in the washing machine, which finely divides hydro cluster, by which the washing water is easily permeated in fibers of the washed clothings.

2. Description of the Prior Art

Activators for the cleaning water are those known as electrone stones, far infrared ray radiation ceramics particle stones, piezo-electric ceramics particle stones contained in the vessel which is set in the cleaning water.

A further device provided with a floating at side face of this vessel is known.

We found problems of insufficient activation of the cleaning water, for hydro activation materials filled in the known auxiliary device are limited to electron stones, far infrared ray radiation ceramics particle stones, and piezo-electric particle stones.

Furthermore, as a vessel containing said hydro activating elements do not conduct activation through the entire cleaning water in the washing machine vat when the former vessel sinks to the bottom of the washing machine vat, there is a need to driftedly float at a water surface. We have found a drawback that the entire vessel has not been floated, as the conventional device with the float ring provided at a vessel side periphery has small floating force of the float ring as well as its attaching position has been a side periphery face, not an upper end of the vessel.

SUMMARY OF THE INVENTION

A primary object of this invention is to remarkably improve hydro activation effect with fill of high activation effect hydro activation element and attachment of the high floating force float member separately with shock absorber, to raise floating force of the entire vessel, so that all the drawbacks are solved.

For this object, a device is disclosed wherein a semi disk shape vessel main body is protruded at its upper and lower faces which have numerous through holes for passing water to permeate the vessel main body interior at those upper and lower faces; provided with a shock absorber at said vessel main body at its side periphery, attached with a float at the vessel main body on its upper center; and contained with a ceramic ball, tormalin phonetically) resin, a magnet and copper fibers.

A device is also provided with a vessel which is generally cylindrical, which has numerous water passing perforations at a side periphery face of the vessel main body to freely pass the water therein, the vessel being attached with a shock absorber at the side periphery face near its upper and lower ends, and attached with a float at upper center; and the vessel main body contains the ceramic ball, tormalin resin, a magnet and a copper fiber therein.

There is also an auxiliary device to activate cleaning water comprising sintered silver made foil on a surface of the ceramic ball.

BRIEF DESCRIPTION OF THE ACCOMPANYING DRAWINGS

DESCRIPTION OF THE PREFERRED EMBODIMENTS

Figure 1:
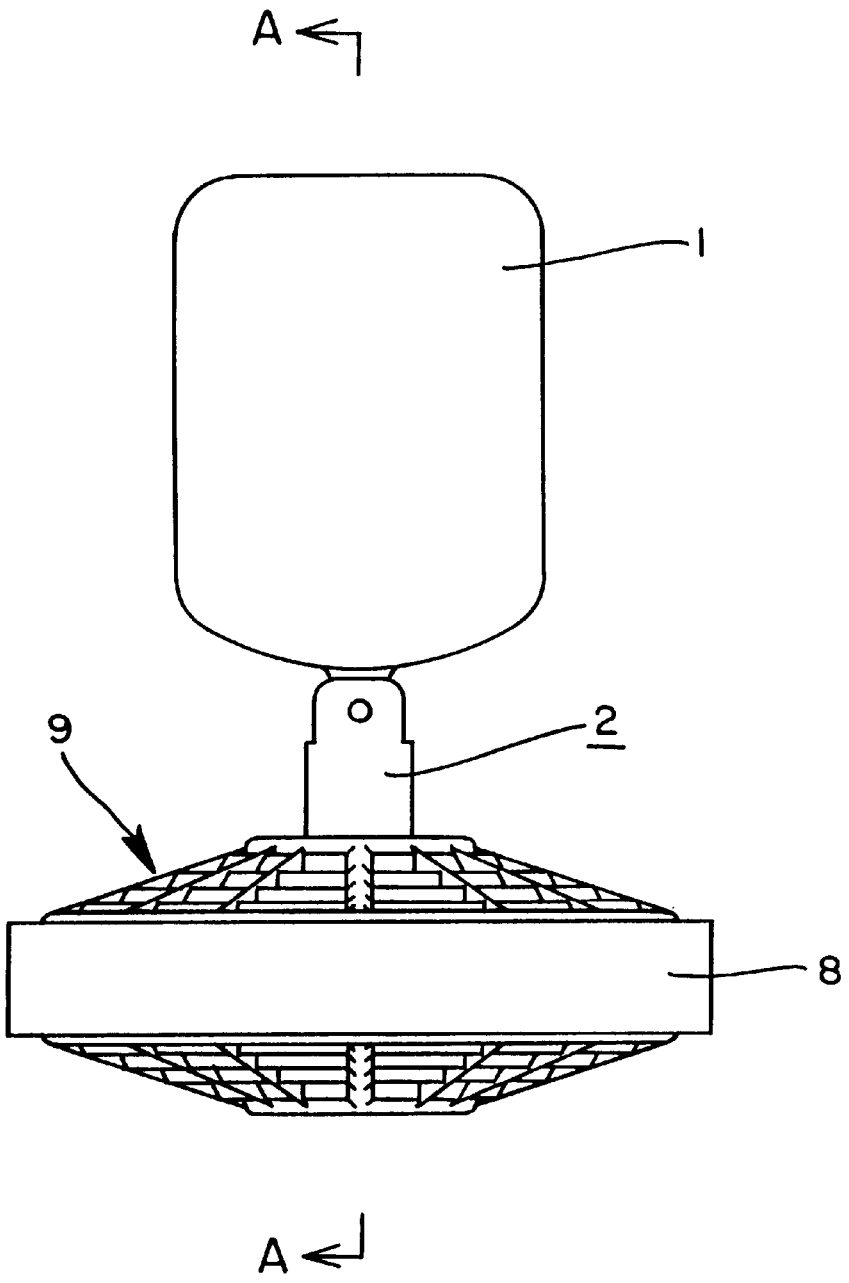
FIG. 1 is a front view of the auxiliary device comprising a disk shape vessel main body relating to the invention.
Figure 2:
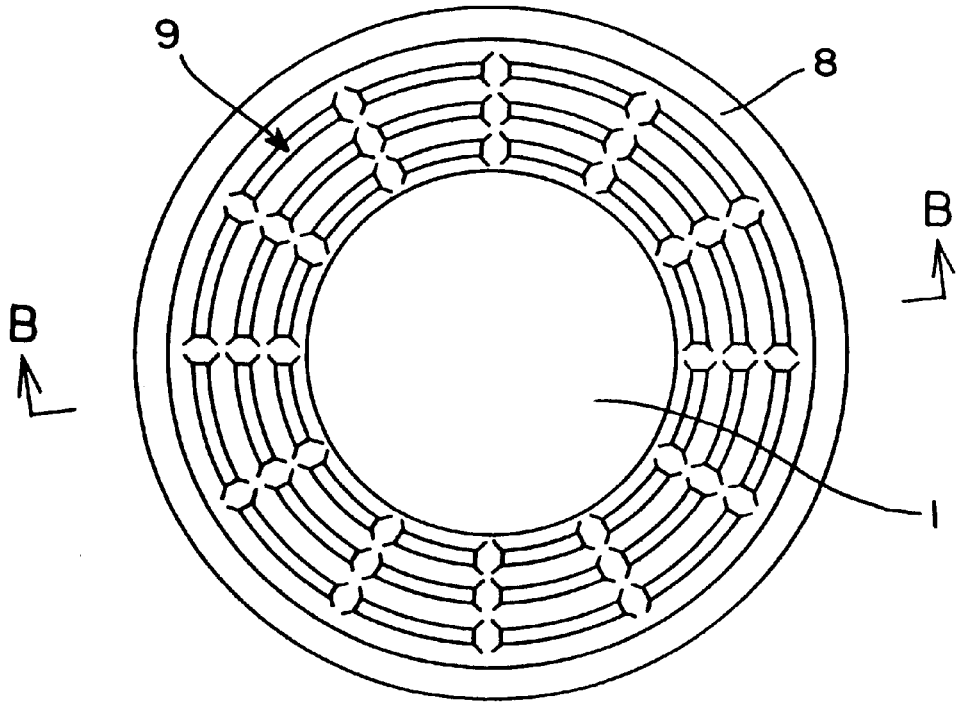
FIG. 2 is a plan view of the device.
Figure 3:
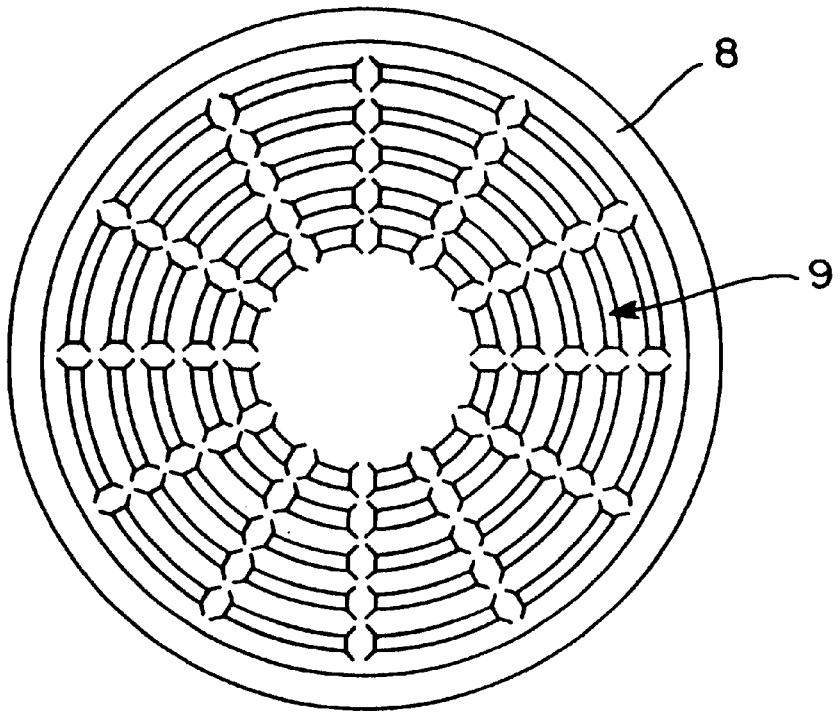
FIG. 3 is a bottom view of the device.
Figure 4:
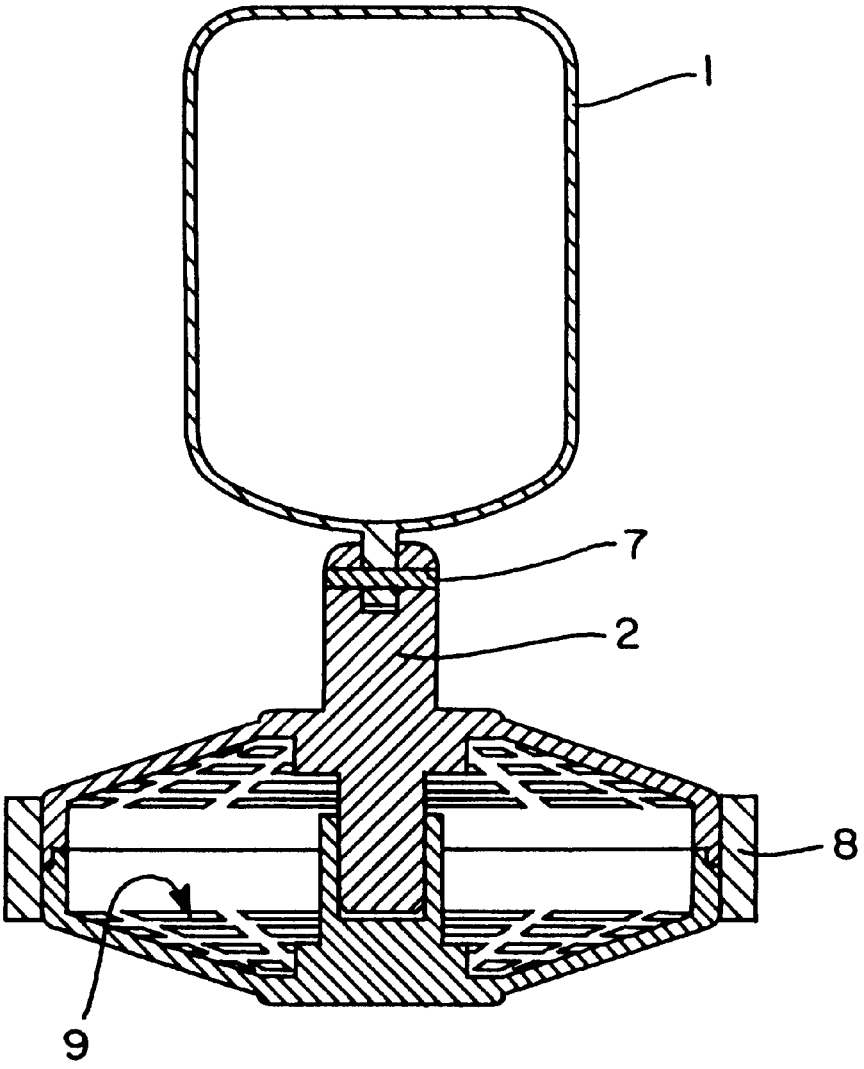
FIG. 4 is a cross section along line A—A.
Figure 5:
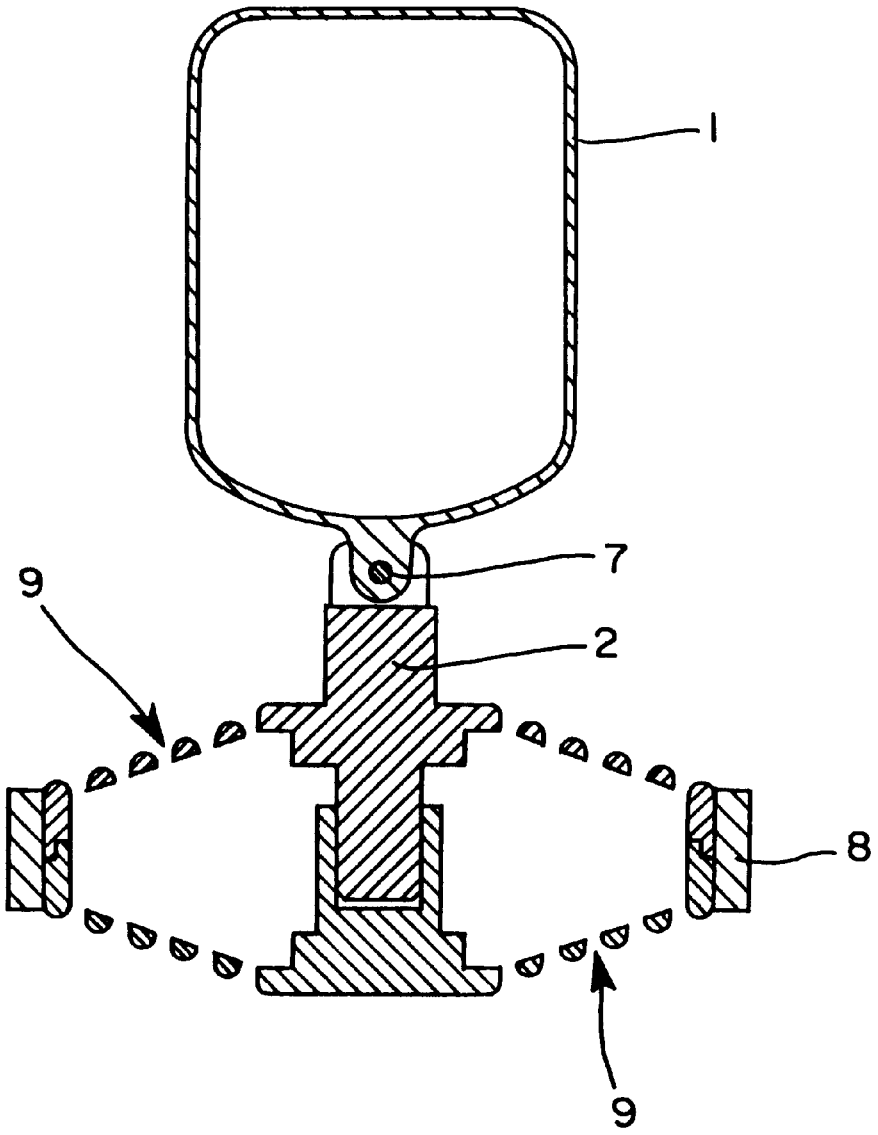
FIG. 5 is a cross section along line B—B.
Figure 6:
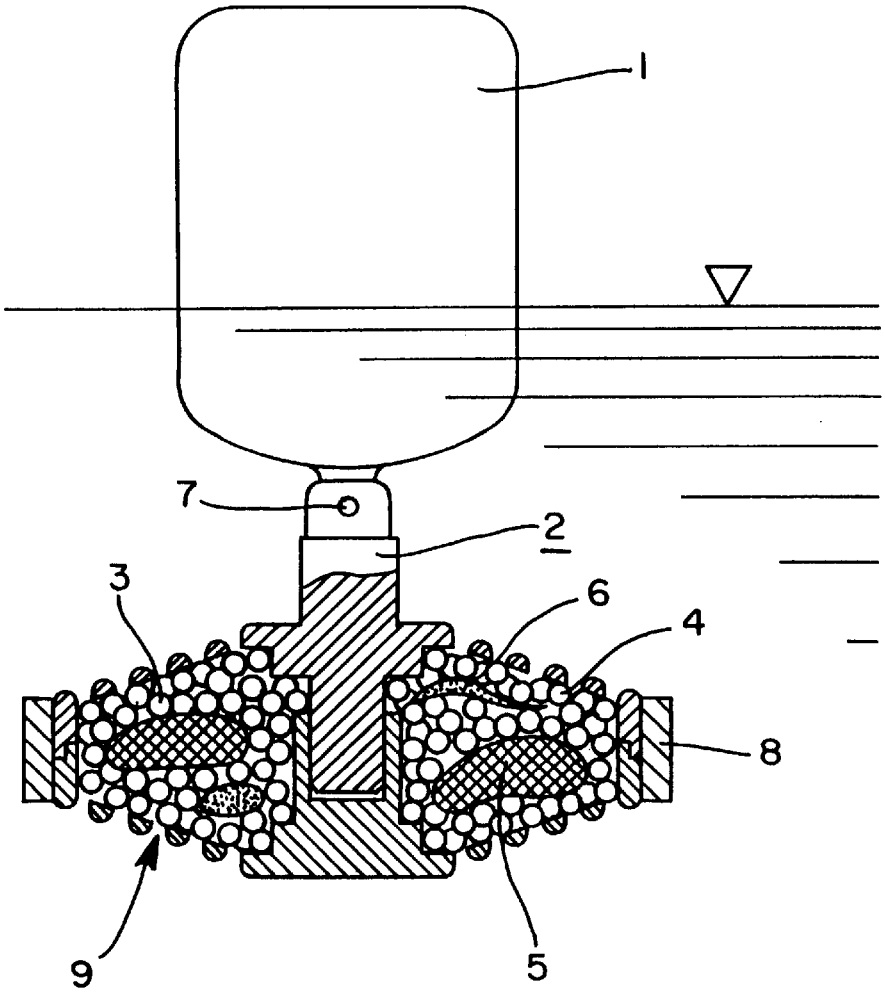
FIG. 6 is a major cross sectional front view.

The device will be hereinafter discussed with reference to the accompanying drawings.

FIGS. 1 to 7 are explanatory views of the vessel main body of generally disk shape along this invention.

The vessel main body 2 is of generally disk shape, upper and bottom surfaces of which are raised so that its center becomes higher.

Attached to the vessel main body 2 at its upper center is a float 1, floating force of which is so selected to float and drift the vessel 1 on a surface of the cleaning water 21 in the washing vat 20.

Figure 7:
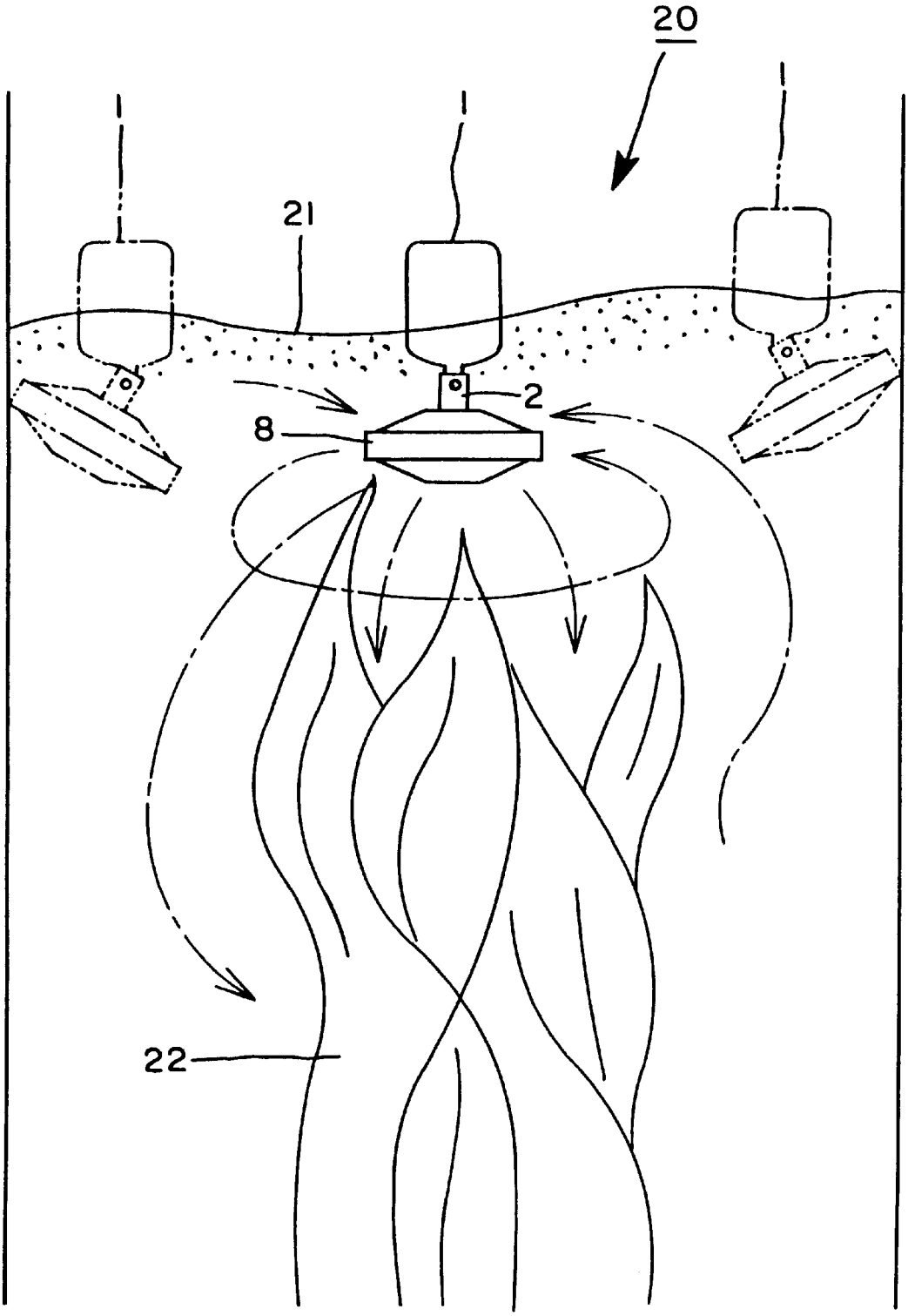
FIG. 7 is an explanatory view showing its usage.
Figure 8:
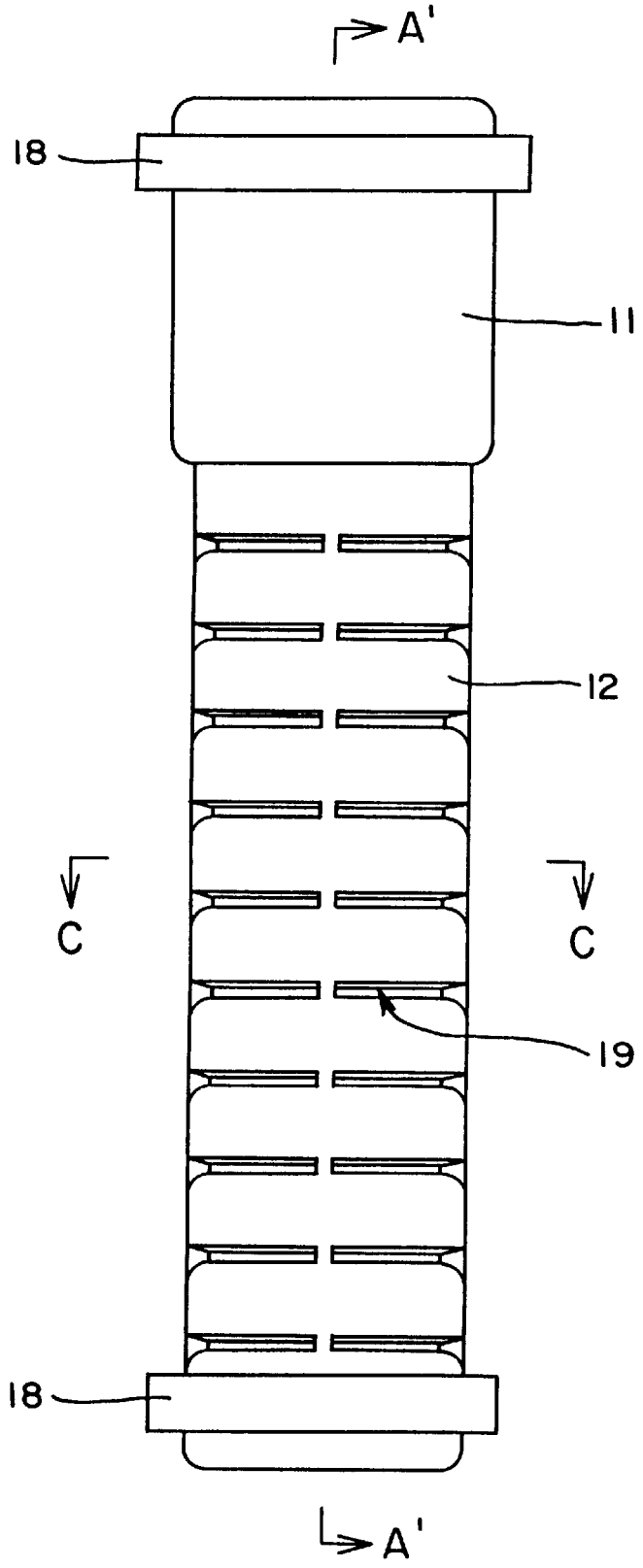
FIG. 8 is a front view of the auxiliary device comprising a cylindrical vessel main body relating the invention.
Figure 9:
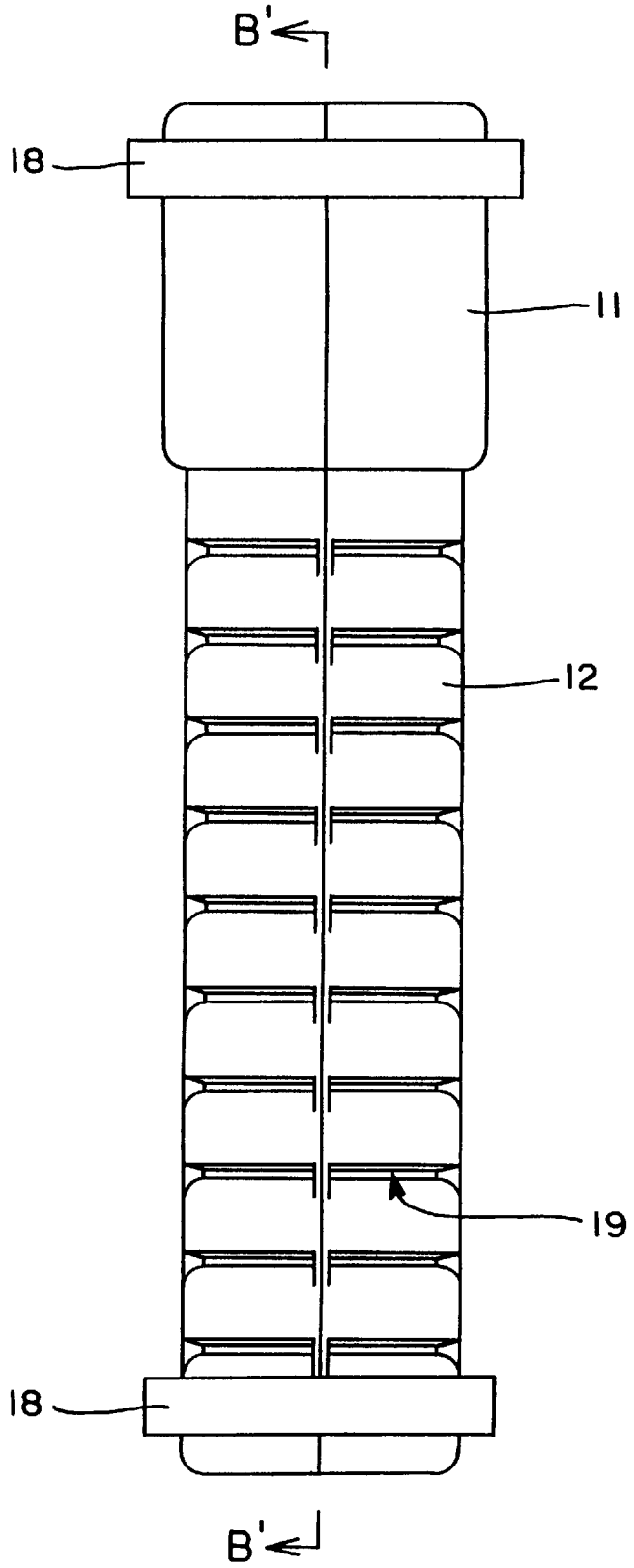
FIG. 9 is a side view of the device.
Figure 10:
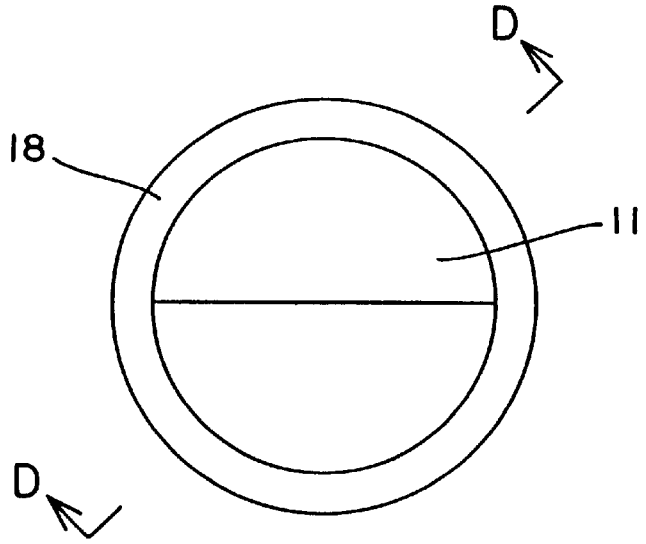
FIG. 10 is a plan view of the device.
Figure 11:
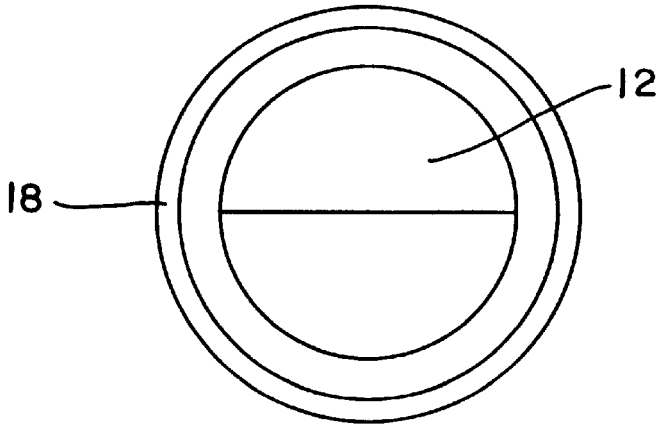
FIG. 11 is a bottom view of the device.
Figure 12:
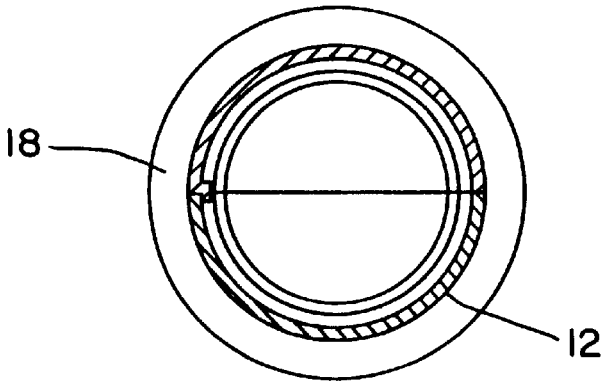
FIG. 12 is a cross section along line C—C in FIG. 8.
Figure 13:
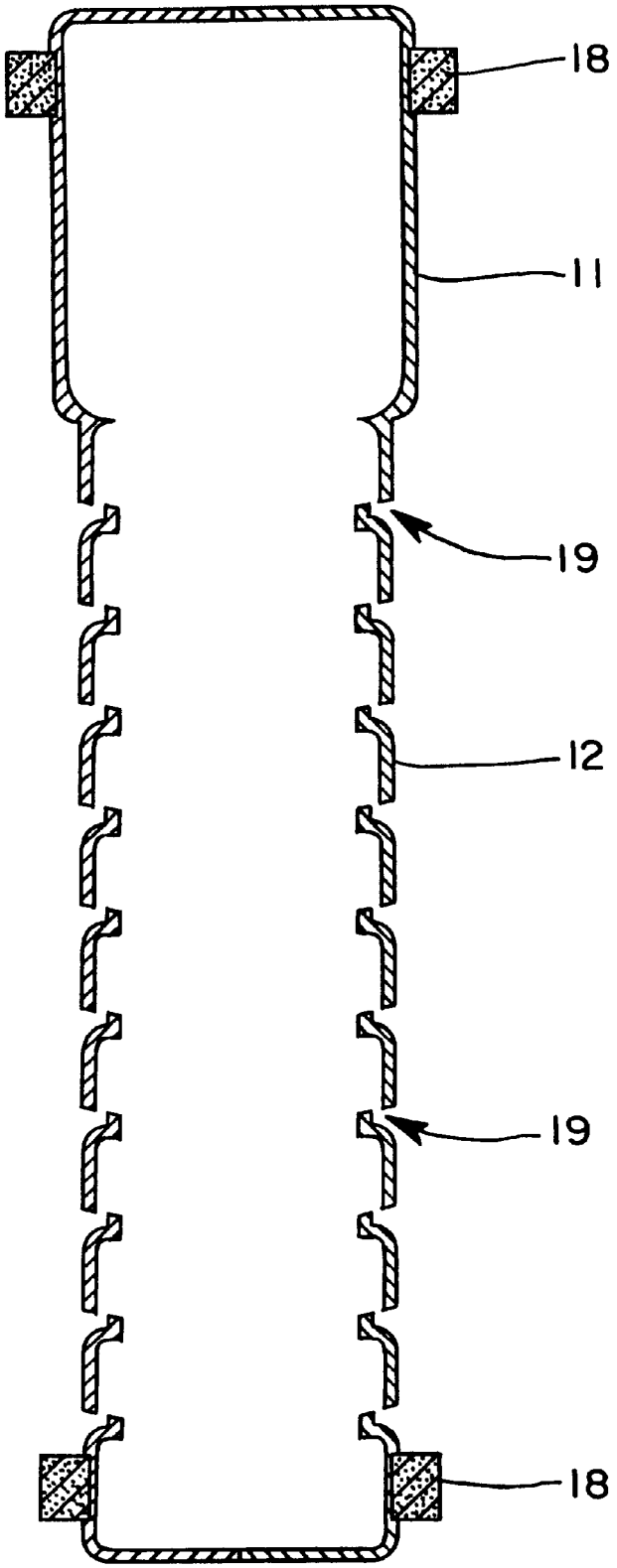
FIG. 13 is a cross section along line B'—B' in FIG. 9.
Figure 14:
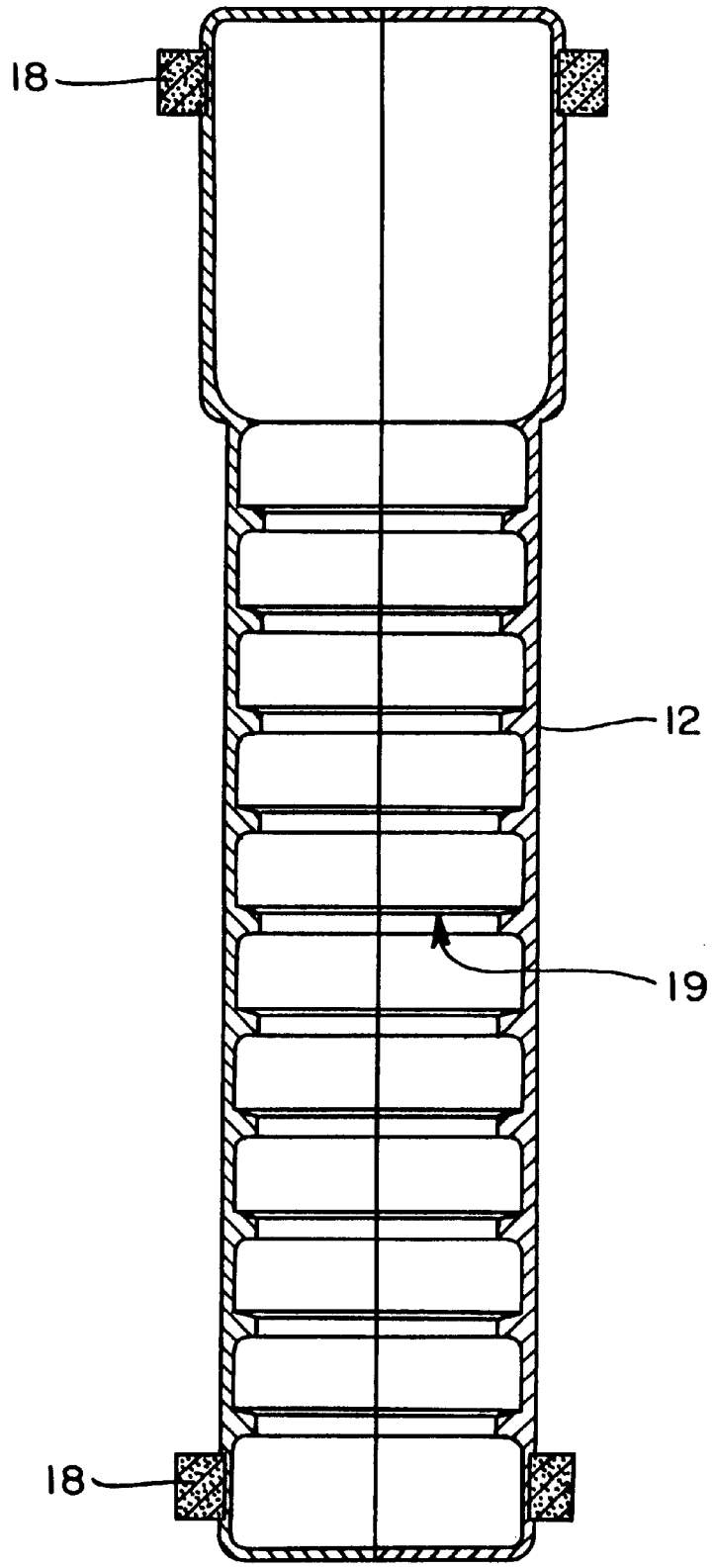
FIG. 14 is a cross section along line A'—A' in FIGS. 8.
Figure 15:
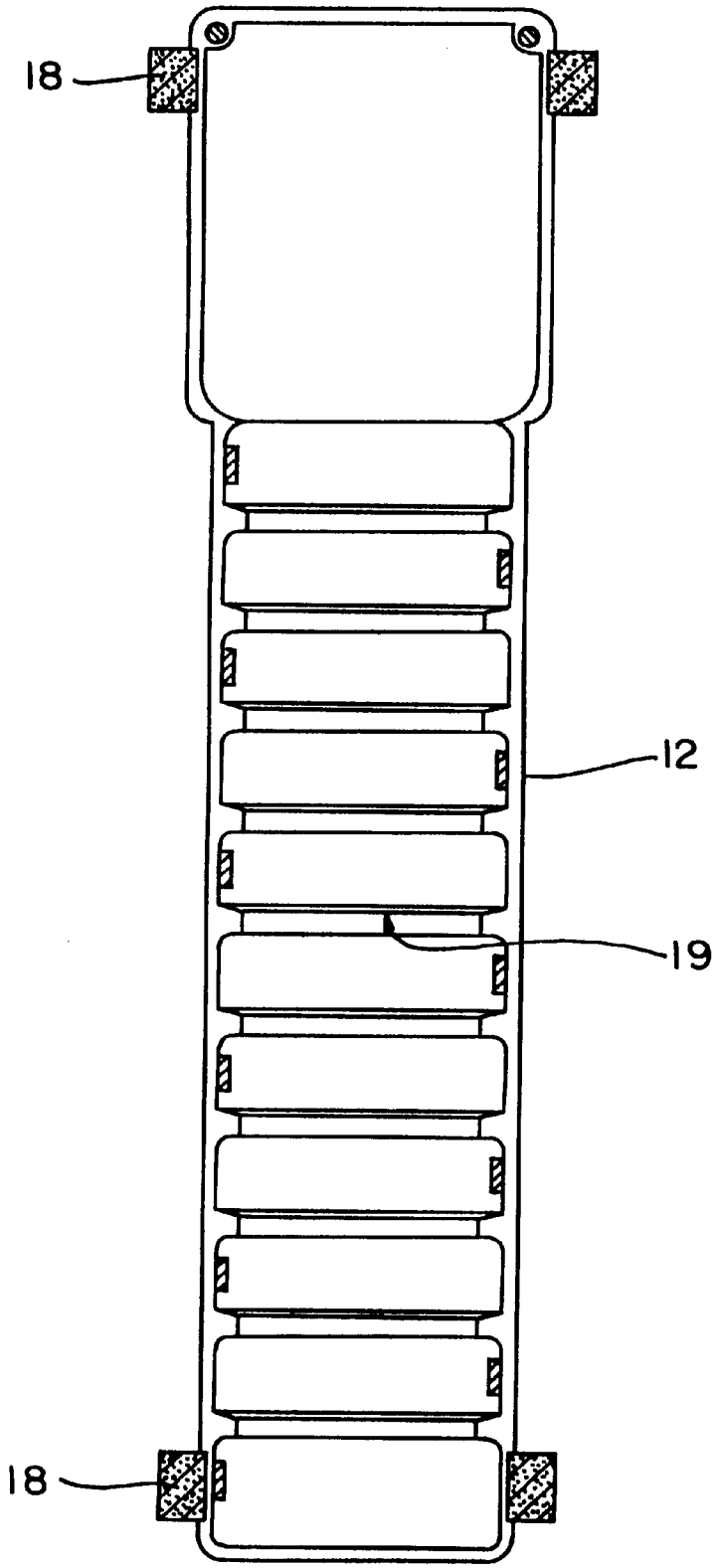
FIG. 15 is a cross section along line D—D in FIG. 10.
Figure 16:
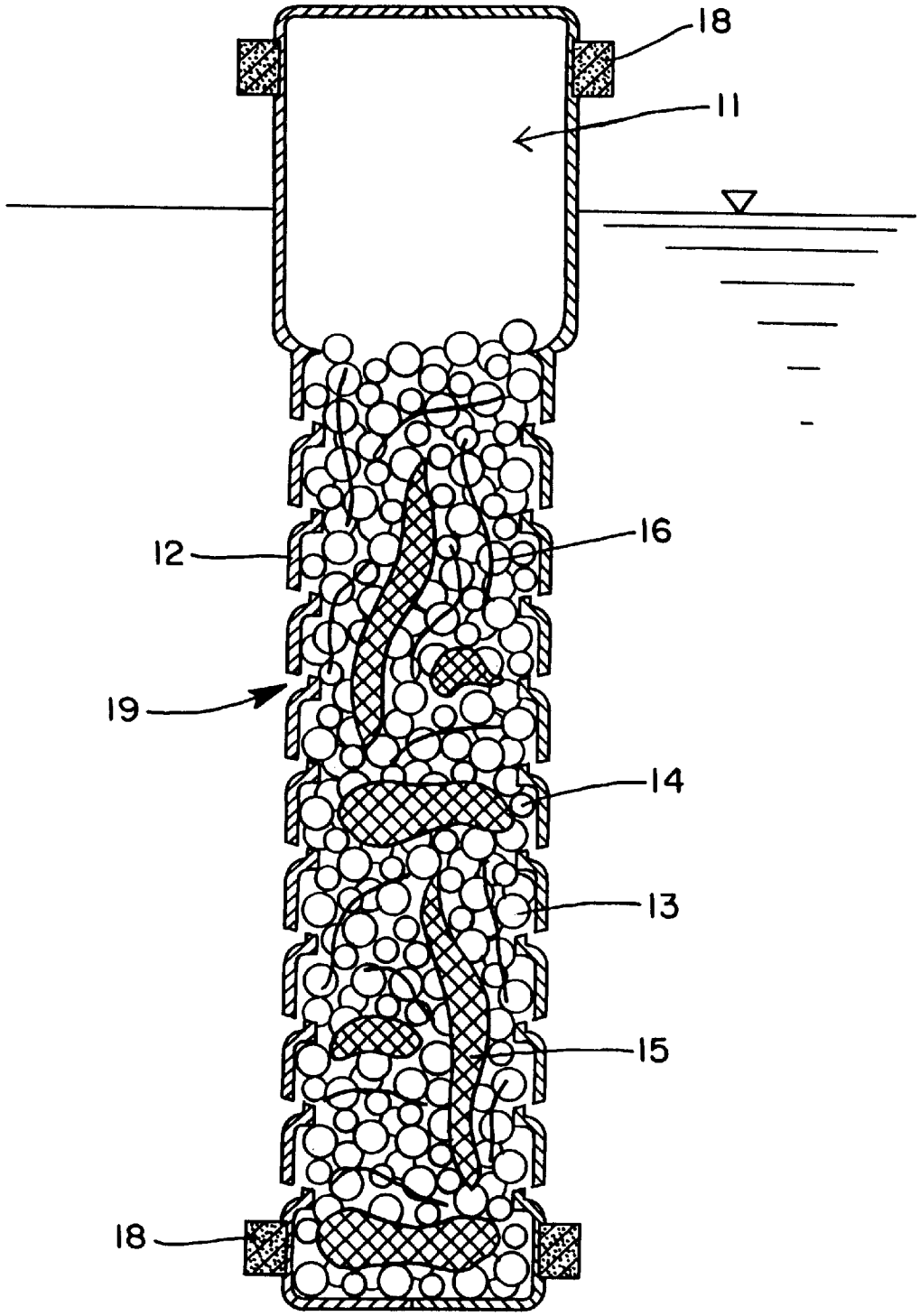
FIG. 16 is a major cross sectional front view of a state wherein hydro activator is filled in the vessel main body.
Figure 17:
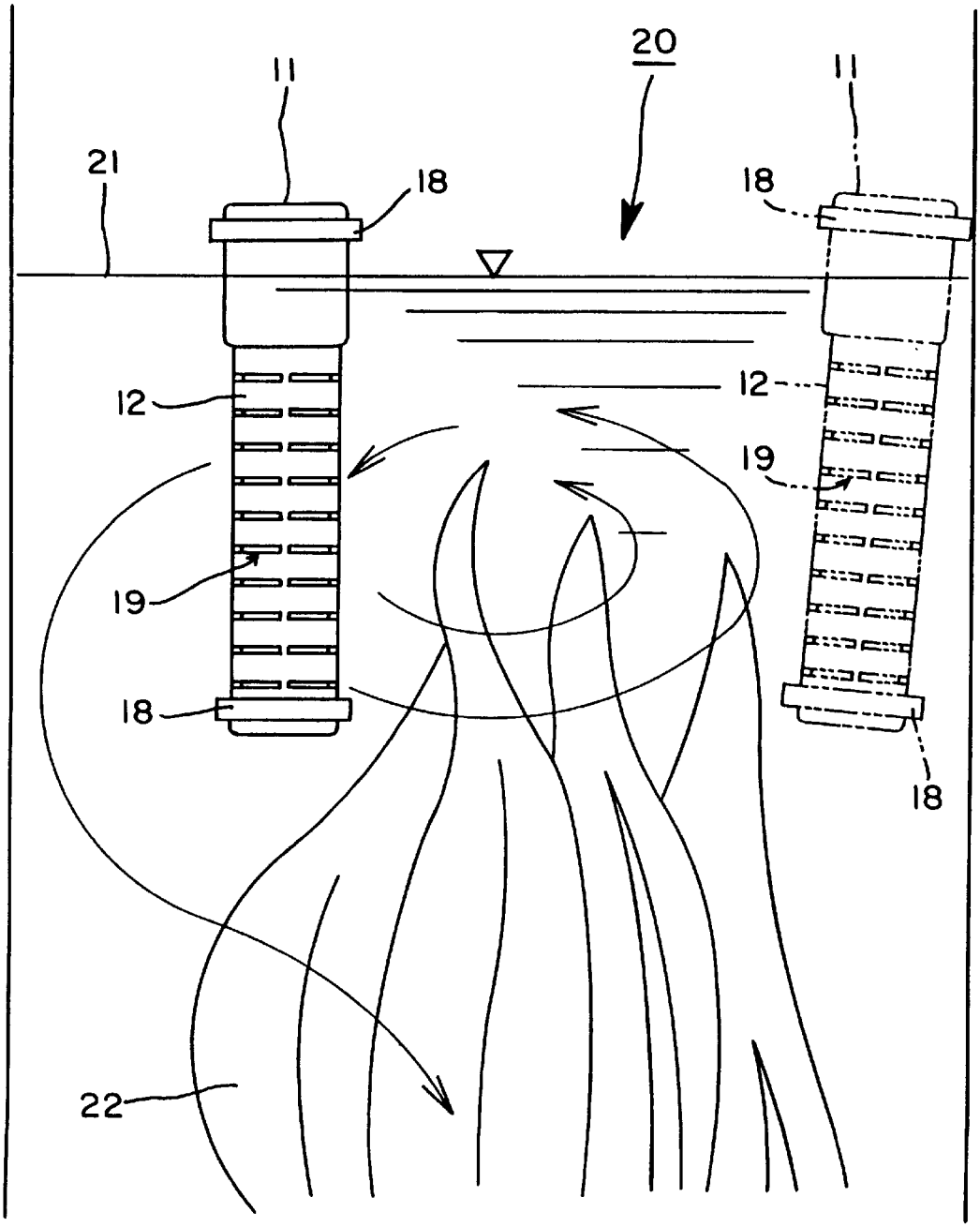
FIG. 17 is an explanatory view showing its usage.

This float I is fixed onto the vessel main body 2, and/or may be attached to the vessel main body 2 through a swing journal 7 as shown in FIG. 7 When the float 1 is swingable the vessel main body is kept at its figure at an abrupt water rush.

Wound around the vessel main body 2 at its side peripheral face is a shock absorber 8 in right manner, which absorbs shock when the vessel main body 2 abuts the vat wall in the washing machine vat 20, to prevent the vessel main body from its breakage.

This invention provides separate shock absorber 8 and float 1, latter of which is attached at a top of the vessel main body 2. Pierced on said vessel main body at its upper and lower surfaces are numerous water passing perorations 9, through which cleaning water 21 contacts with hydro activator filled in the vessel main body 2 for activating the water.

The hydro activator within the vessel main body 2 are ceramic ball 3, tormalin resin 4, magnet 5 and/or copper fiber 6. The ceramic ball 3 comprises a ceramic ball to emit far infrared ray effectively, normally formed as 3 to 8 mm in diameter particles which are filled within the vessel main body 2 (normally 30 to 60 g), When the cleaning water is agitated and the ceramic ball is twisted within the vessel main body 2 which causes a friction weak energy of the far infrared ray is generated, which generates resonance vibration of the hydro molecule, which changes structure of the hydro molecule to cause the small cluster of the washing water.

The resonance vibration improves a hydro affinity and causes dirty water viscosity, separated from the washed clothing to be low.

Dissolved oxygen in the water becomes activated oxygen reactive after receiving far infrared ray and is bonded with hydrogen ion to become hydro peroxygen, which provides bleaching and anti-bacterial effect.

The tormalin resin 4 is mixed after the raw tormalin stone is powdered and mixed into resin, which is pelletized and/or shaped into a bar plate and packed to 30 to 100 g.

When the tormalin resin 4 is put into the washing water 21 in the washing vat 20, the cluster is dissolved by high voltage of the tormalin, returns to normal molecular state.

Hence, activated osmotic pressure of the water and surfactant effect separate the washed clothing from dirt, which provides good washing and cleaning action without soap.

The magnet 5 provides magneticity (1200 gausses) to the washing water, which contracts the cluster of the washing water for activation.

The copper fiber 6 is filled for the object of absorption and is dissolved by the fluorine added to the water for decoloring the washed clothing and anti-bacterial held by the metal (normally 3 to 10 g are appropriate).

FIG. 8 to 17 are explanatory views of the vessel main body 12 in generally cylindrical shape, of this invention.

The generally cylindrical vessel main body 12 is the same as said generally disk shape vessel main body in its usage and function of constitutional member.

Perforated on side peripheral faces of this cylindrical vessel main body 12 are water passing through holes 19 and wound around the side peripheral surfaces at upper and lower ends of the vessel main body 12 are a pair of shock absorbers 18,18 in ring configuration.

Attached on the cylindrical vessel main body 12 at its upper center is a float 11 which controls its figure to rotate in the washer's vat along the water flow.

Filled in the cylindrical vessel main body 12 are a ceramic ball 13, tormalin resin 14, magnet 15 and copper fiber 16, explanation of which is the same as said same elements.

The ceramic balls 3.13 of this invention may be covered with silver thin foil as required, which provides improved anti-bacterial effect for the washing water.

Hence, when the auxiliary device to activate the washing water in the washing water 21 is in the washer's vat 20, the water 21 contacts with the hydro activating element filled in each vessel main body 2.12 through the water passing through holes 9,19 to effect water activation.

This activation effect clean washing of the clothing in the vat 20, without soap.

I claim:

1. An auxiliary device for activating washing water comprising generally disk shaped vessel main body which has raised projections at its upper and lower surfaces; shock absorbers on said main body at its side periphery; numerous water passing holes for passing water into the main body perforated on said upper and lower faces; a float on the vessel main body at its upper center; and a ceramic ball, tormalin resin, a magnet and copper fiber contained in said vessel main body.

2. An auxiliary device according to claim 1, wherein said vessel main body is generally cylindrical, said shock absorber being attached on said main body at its side periphery rear upper and lower ends.

3. An auxiliary device according to claim 2, wherein the ceramic ball has a sintered silver layer on its surface.

4. An auxiliary device according to claim 1, wherein the ceramic ball has a sintered silver layer on its surface.

5. An auxiliary device according to claim 4, wherein the ceramic ball has a sintered silver layer on its surface.

* * * * *